US006698630B1

(12) United States Patent
Maguire

(10) Patent No.: US 6,698,630 B1
(45) Date of Patent: Mar. 2, 2004

(54) COMBINATION SHOEHORN AND SHOE COUNTER CLIP

(76) Inventor: Mark T. Maguire, 4869 Robin Hill Dr., Omaha, NE (US) 68106

( * ) Notice: Subject to any disclaimer, the term of this patent is extended or adjusted under 35 U.S.C. 154(b) by 0 days.

(21) Appl. No.: 10/159,760

(22) Filed: May 30, 2002

(51) Int. Cl.[7] ..... A47G 25/80
(52) U.S. Cl. ..... 223/118; 223/113
(58) Field of Search ..... 223/113, 118, 223/119

(56) References Cited

U.S. PATENT DOCUMENTS

| | | | | | |
|---|---|---|---|---|---|
| 457,115 | A | * | 8/1891 | Gysin | 223/119 |
| 470,109 | A | * | 3/1892 | Dickinson | 223/119 |
| 594,894 | A | * | 12/1897 | Nylander | 223/118 |
| 686,512 | A | * | 11/1901 | Duvall | 223/118 |
| 1,163,399 | A | * | 12/1915 | Fox | 223/118 |
| 2,628,007 | A | * | 2/1953 | Meling | 223/111 |
| 2,903,170 | A | * | 9/1959 | Ahn | 223/111 |
| 2,939,618 | A | * | 6/1960 | Mangels | 223/113 |
| 3,165,246 | A | | 1/1965 | Stearns | |
| 3,410,463 | A | * | 11/1968 | Carlos | 223/119 |
| 3,501,073 | A | | 3/1970 | Breithor | |
| 3,692,217 | A | | 9/1972 | Smith | |
| 3,883,052 | A | | 5/1975 | Wilson | |
| D310,908 | S | | 10/1990 | Santore | |
| 5,566,868 | A | * | 10/1996 | Mariscal et al. | 223/113 |
| 5,636,774 | A | | 6/1997 | Moscato | |
| 5,655,693 | A | * | 8/1997 | Engelman et al. | 223/119 |

* cited by examiner

*Primary Examiner*—John J. Calvert
*Assistant Examiner*—James G Smith
(74) *Attorney, Agent, or Firm*—Thomte, Mazour & Niebergall; Dennis L. Thomte

(57) ABSTRACT

A combination shoehorn and shoe counter clip is disclosed which comprises an elongated member or handle having upper and lower ends. A U-shaped horn portion is secured to the lower end of the elongated member at the forward side thereof to create a clip space therebetween. The counter of the shoe to be donned is positioned within the clip space and the individual is able to maneuver the shoe as required since the shoe is securely held in the clip space.

10 Claims, 4 Drawing Sheets

COMBINATION SHOEHORN AND SHOE COUNTER CLIP

BACKGROUND OF THE INVENTION

1. Field of the Invention

This invention relates to a shoehorn and more particularly to a combination shoehorn and shoe counter clip to enable a person to put on their shoes.

2. Description of the Related Art

Donning a pair of shoes is a simple task which most people take for granted. A significant number of people have difficulty donning their shoes, for example, the elderly, the physically challenged and the obese. Deficits, such as extreme low back pain, compromised dexterity-flexibility-coordination, and upper extremity paresis, can complicate the task of donning shoes. Typical short or long shoehorns have many shortcomings and are not ideally suited for assisting a person such as those described above who have difficulty donning their shoes. People having the infirmities described above have attempted to don their shoes using the traditional long plastic shoehorn, but find it difficult to properly place their heel on the narrow plastic device, allowing the heel to lose contact and slip off. For an individual attempting to overcome physical barriers, this can be a frustrating and discouraging task. Further, many people lack the coordination to keep a traditional shoehorn positioned inside the counter of the shoe. This task is even further complicated when the person attempts to use a short shoehorn.

SUMMARY OF THE INVENTION

A combination shoehorn and shoe counter clip is described for use in positioning a person's foot in a shoe with the shoe including a counter with an upper rearward end having rearward and forward sides. The device comprises an elongated member having an upper end, an intermediate portion and a lower end with the elongated member having forward and rearward sides. An arcuate, generally U-shaped or funnel-shaped horn portion is secured to the elongated member above the lower end thereof so as to be positioned at the forward side thereof. The U-shaped horn portion has an upper end, a lower end, a rearward side, a forward side, and opposite side edges. The forward side of the lower end of the elongated member is positioned adjacent the rearward side of the U-shaped horn portion to define a space into which the upper rearward end of the shoe counter may be selectively removably placed and clipped therein to enable a person to maneuver the shoe by grasping the elongated member. The lower end of the horn portion is received within the shoe counter when the upper rearward end of the shoe counter is positioned within the space. To use the device of this invention, an individual places a shoe on their lap and clips the device to the counter of the shoe. The individual then uses the elongated member to place the shoe on the ground in the desired position. While still holding onto the elongated member, the individual places their toes into the shoe. As this point, the individual is able to let go of the elongated member and uses their free hand to hold the tongue of the shoe to prevent it from collapsing into the shoe. While pushing their foot into the shoe, the horn portion of the device acts to guide the uncontrolled and sometimes unseen heel into the shoe. Once the heel is funneled into the shoe, the individual grasps the elongated member to pull the horn portion out of the shoe. The device of this invention is effective for individuals capable of bending over while sitting and more importantly may be successfully used by individuals not capable of bending over due to conditions such as low back pain, obesity, etc.

It is therefore a principal object of the invention to provide an improved device for positioning a person's foot in a shoe.

A further object of the invention is to provide a device which enables a person having physical infirmities to don their shoes.

A further object of the invention is to provide a device which clips onto the counter of the shoe and which includes a funnel portion or horn portion which extends downwardly into the shoe adjacent the forward side of the counter to guide the person's foot into the shoe.

These and other objects will be apparent to those skilled in the art.

DESCRIPTION OF THE PREFERRED EMBODIMENT

The numeral 10 refers generally to the combination shoehorn and shoe counter clip of this invention while the numeral 12 refers to a conventional shoe which includes a counter 14 at its rearward end with the counter having an upper end, and rearward and forward sides.

Figure 2:
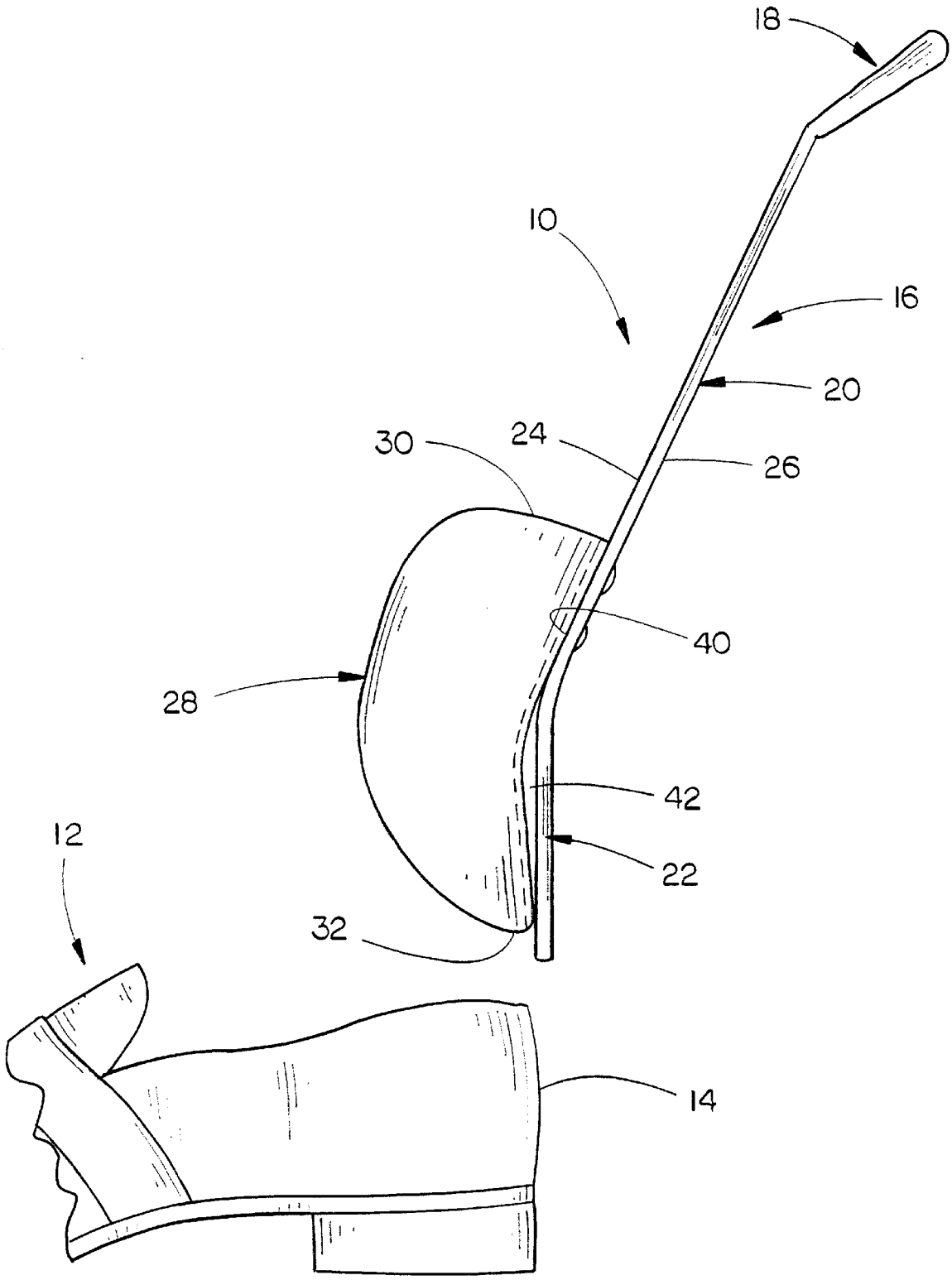
FIG. 2 is a side elevational view of the device which illustrates its relationship to a shoe.

Preferably, the device 10 is comprised of a plastic material although it is possible that other materials could be used to form the device 10. Device 10 includes an elongated member 16 having an upper hand gripping portion 18, intermediate portion 20 and lower end portion 22. For purposes of description, the elongated member 16 will be described as having a forward side 24 and a rearward side 26. While the hand grasping or gripping portion 18 is angularly disposed rearwardly with respect to the intermediate portion 20, as best seen in FIG. 2, it can be shaped to virtually any configuration to accommodate the hand and fingers. Preferably, the lower end portion 22 of elongated member 16 is also angularly disposed rearwardly with respect to intermediate portion 20. While the lower end portion 22 has a flat rectangular configuration, it can be shaped in any configuration to best couple with the counter.

Figure 1:
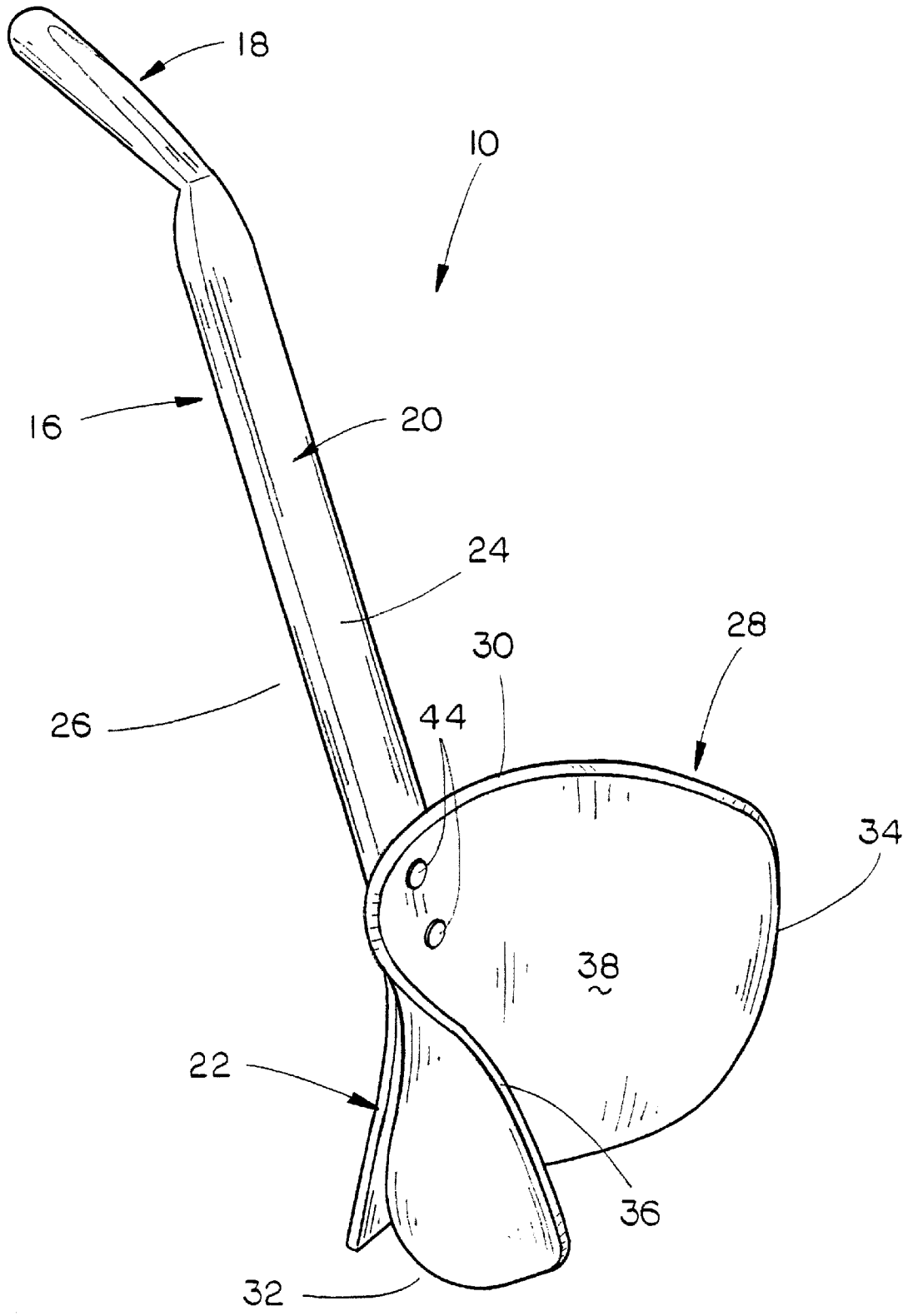
FIG. 1 is a front perspective view of the device of this invention.

The numeral 28 refers to a generally U-shaped horn portion having an upper end 30, lower end 32, opposite side edges 34 and 36, a forward side 38, and a rearward side 40. As best seen in FIG. 2, the rearward side 40 of horn portion 28 is angularly disposed so as to create a space 42 between the rearward side of the horn portion 28 adjacent the lower end thereof and the forward side of lower end portion 22 of elongated member 16. It is preferred that the lower end portion 22 have sufficient flexibility so as to be in resilient engagement with the lower end portion 32 of horn portion 28, as seen in FIG. 2, to provide a counter clip as will be described in detail hereinafter. As seen in FIG. 1, the upper end of horn portion 28 is secured to elongated member 16 above the lower end thereof by means of rivets 44 or the like. Further as seen in FIG. 2, the lower end of the elongated member is disposed below the lower end of the horn portion.

Figure 3:
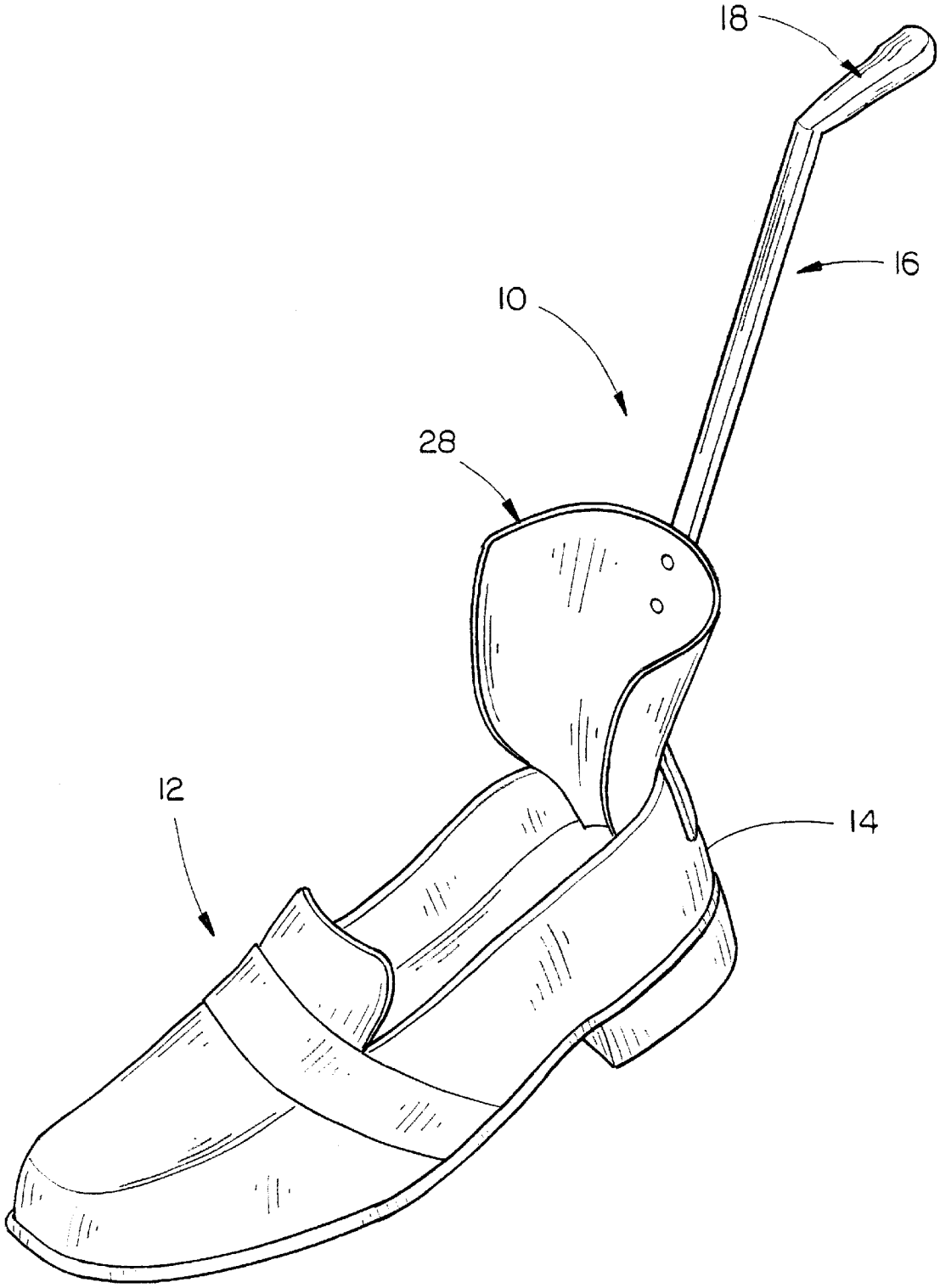
FIG. 3 is a front perspective view of the device having a shoe clipped thereon.
Figure 4:
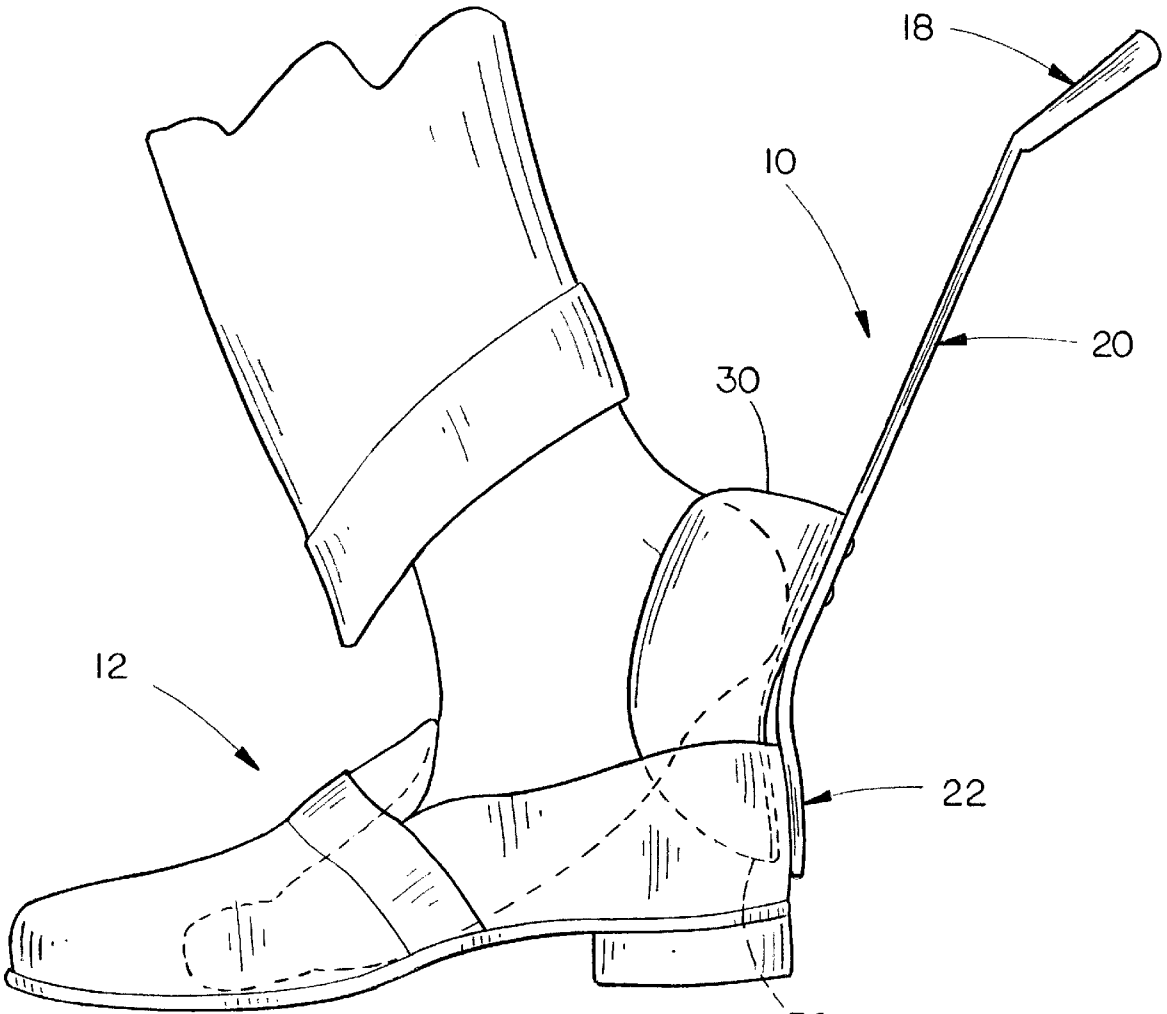
FIG. 4 is a side elevational view illustrating the manner in which the device is used to guide a person's foot into a shoe.

To use the device 10, the individual places the shoe 12 on their lap and clips the device 10 to the counter 14 of the shoe. The clipping action is achieved by the counter 14 being received between the rearward side of the lower end of the horn portion 28 and the forward side of the lower end portion 22 of elongated member 16. When the device 10 has been positioned with respect to the shoe 12, as seen in FIG. 3, the lower end of the horn portion 28 is received within the shoe forwardly of the counter 14 and with the lower end portion 22 of elongated member 16 being positioned at the rearward side of the counter. As seen in the drawings, the lower end of the horn portion 28 has a width which is less than the width of the upper end of the horn portion 28 so that the horn portion 28 "funnels" the person's heel into the shoe, as best seen in FIG. 4. When the device has been clipped onto the shoe, as illustrated in FIG. 3, the individual then uses the elongated handle or member 16 to place the shoe on the ground in the desired position. While still holding onto the handle, the individual places their toes into the shoe. At this point, the individual is able to let go of the handle and use their free hand to hold the tongue, to prevent it from collapsing into the shoe providing the individual is able to reach the tongue. While pushing their foot into the shoe, the funnel shape of the horn portion 28 acts to guide the uncontrolled and sometimes unseen heel into the shoe. Once the heel is funneled into the shoe, the individual uses the elongated member 16 to pull the device out of the shoe. Donning the shoe is now complete.

While this device is very effective for individuals capable of bending over while sitting, it can also be successfully used by individuals not capable of bending over such as those persons experiencing low back pain or individuals who are obese.

Thus it can be seen that the device of this invention accomplishes at least all of its stated objectives.

I claim:

1. A device for use in positioning a person's foot in a shoe including a counter with an upper rearward end having rearward and forward sides, comprising:

an elongated member having an upper end, an intermediate portion and a lower end;

said elongated member being of one-piece construction;

said elongated member having forward and rearward sides;

an arcuate, generally U-shaped horn portion having an upper end, a lower end, a rearward side, a forward side and opposite side edges;

said elongated member being fixedly secured, above its lower end, to said U-shaped horn portion above the lower end thereof to define a resilient clip portion at the lower end of said elongated member;

said lower end of said elongated member being disposed below said lower end of said horn portion;

said resilient clip portion having rearward and forward sides and a lower end;

said resilient clip portion being positioned rearwardly of said rearward side of said U-shaped horn portion being in resilient engagement and;

said forward side of said lower end of said resilient clip portion being resiliently movably positioned adjacent said rearward side of said U-shaped horn portion;

said lower end of said clip portion and said horn portion being yieldably movable away from one another to define a space into which the upper rearward end of the shoe counter may be selectively removably placed to enable a person to maneuver the shoe by grasping the elongated member;

said lower end of said horn portion being received within the shoe counter when the upper rearward end of the shoe counter is positioned within said space.

2. The device of claim 1 wherein said resilient clip portion is sufficiently resilient so as to securely engage the shoe counter when the shoe counter is positioned in said space.

3. The device of claim 1 wherein said upper end of said horn portion is secured to said elongated member above the said lower end of said elongated member.

4. The device of claim 1 wherein said resilient clip portion is angularly disposed with respect to said intermediate portion of said elongated member.

5. The device of claim 1 wherein said upper end of said elongated member is angularly disposed with respect to said intermediate portion.

6. The device of claim 5 wherein said resilient clip member is angularly disposed with respect to said intermediate portion of said elongated member.

7. The device of claim 5 wherein said upper end of said elongated member defines a gripping portion.

8. The device of claim 1 wherein said upper end of said horn portion has a greater width than said lower end of said horn portion.

9. The device of claim 1 wherein said elongated member and said horn portion are comprised of a plastic material.

10. The device of claim 1 wherein said elongated member is comprised of a one-piece plastic material.

* * * * *